US007128160B2

(12) United States Patent
Anyan et al.

(10) Patent No.: US 7,128,160 B2
(45) Date of Patent: Oct. 31, 2006

(54) METHOD AND APPARATUS TO SELECTIVELY REDUCE WELLBORE PRESSURE DURING PUMPING OPERATIONS

(75) Inventors: Steven L. Anyan, Bartlesville, OK (US); Stephane J. Virally, Sugar Land, TX (US); Olukemi Ibironke Aardalsbakke, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 183 days.

(21) Appl. No.: 10/442,783

(22) Filed: May 21, 2003

(65) Prior Publication Data

US 2004/0231853 A1 Nov. 25, 2004

(51) Int. Cl.
*E21B 34/10* (2006.01)

(52) U.S. Cl. ..... 166/374; 166/53; 166/323; 166/386

(58) Field of Classification Search ..... 166/278, 166/373, 374, 376, 381, 386, 51, 53, 316, 166/317, 319, 320, 321, 323, 332.1
See application file for complete search history.

(56) References Cited

U.S. PATENT DOCUMENTS

| | | | | |
|---|---|---|---|---|
| 3,818,986 | A * | 6/1974 | Abney et al. | 166/51 |
| 3,830,294 | A * | 8/1974 | Swanson, Jr. | 166/51 |
| 3,884,301 | A | 5/1975 | Turner et al. | |
| 3,994,338 | A * | 11/1976 | Hix | 166/105 |
| 4,049,055 | A * | 9/1977 | Brown | 166/278 |
| 4,522,264 | A * | 6/1985 | McNeer | 166/278 |
| 4,726,419 | A * | 2/1988 | Zunkel | 166/51 |
| 4,856,591 | A * | 8/1989 | Donovan et al. | 166/278 |
| 4,862,957 | A * | 9/1989 | Scranton | 166/51 |
| 4,907,655 | A * | 3/1990 | Hromas | 166/321 |
| 4,940,093 | A * | 7/1990 | Hilsman, III | 166/319 |
| 5,330,003 | A | 7/1994 | Bullick | |
| 5,411,097 | A * | 5/1995 | Manke et al. | 166/324 |
| 6,237,687 | B1 * | 5/2001 | Barbee et al. | 166/278 |
| 6,311,772 | B1 | 11/2001 | Myhre et al. | |
| 6,386,289 | B1 * | 5/2002 | Patel | 166/325 |
| 6,675,891 | B1 * | 1/2004 | Hailey et al. | 166/228 |
| 2002/0036087 | A1 * | 3/2002 | Bixenman et al. | 166/278 |
| 2003/0070809 | A1 | 4/2003 | Schultz et al. | |
| 2003/0075324 | A1 | 4/2003 | Dusterhoft et al. | |
| 2003/0075325 | A1 | 4/2003 | Dusterhoft et al. | |
| 2005/0006092 | A1 * | 1/2005 | Turner et al. | 166/279 |

FOREIGN PATENT DOCUMENTS

| | | |
|---|---|---|
| GB | 2220688 A | 1/1990 |
| GB | 2252347 A | 8/1992 |
| GB | 2377464 A | 1/2003 |
| GB | 2383358 A | 6/2003 |

* cited by examiner

*Primary Examiner*—Jennifer H. Gay
(74) *Attorney, Agent, or Firm*—Robert A. Van Someren; Kevin P. McEnaney; Jaime A. Castano

(57) ABSTRACT

A downhole tool has at least one diverter valve. The at least one diverter valve is used to reduce pressure in a wellbore caused by frictional resistance to fluid flow during a gravel pack operation. The increased pressure tends to be created as the beta wave of the gravel pack operation makes its way up the wellbore.

17 Claims, 2 Drawing Sheets

METHOD AND APPARATUS TO SELECTIVELY REDUCE WELLBORE PRESSURE DURING PUMPING OPERATIONS

BACKGROUND

1. Field of Invention

The present invention pertains to downhole tools used in subsurface well completion pumping operations, and particularly to tools used to enhance the effectiveness of gravel pack operations.

2. Related Art

Gravel packing is a method commonly used to complete a well in which the producing formations are loosely or poorly consolidated. In such formations, small particulates referred to as "fines" may be produced along with the desired formation fluids. This leads to several problems such as clogging the production flowpath, erosion of the wellbore, and damage to expensive completion equipment. Production of fines can be reduced substantially using a screen in conjunction with particles sized not to pass through the screen. Such particles, referred to as "gravel", are pumped as a gravel slurry into an annular region between the wellbore and the screen. The gravel, if properly packed, forms a barrier to prevent the fines from entering the screen, but allows the formation fluid to pass freely therethrough and be produced.

A common problem with gravel packing is the presence of voids in the gravel pack. Voids are often created when the carrier fluid used to convey the gravel is lost or "leaks off" too quickly. The carrier fluid may be lost either by passing into the formation or by passing through the screen where it is collected by a washpipe and returned to surface. It is expected and necessary for dehydration to occur at some desired rate to allow the gravel to be deposited in the desired location. However, when the gravel slurry dehydrates too quickly, the gravel can settle out and form a "bridge" whereby it blocks the flow of slurry beyond that point, even though there may be void areas beneath or beyond it. This can defeat the purpose of the gravel pack since the absence of gravel in the voids allows fines to be produced through those voids.

Another problem common to gravel packing horizontal wells is the sudden rise in pressure within the wellbore when the initial wave of gravel, the "alpha wave", reaches the "toe" or far end of the wellbore. The return or "beta wave" carries gravel back up the wellbore, filling the upper portion left unfilled by the alpha wave. As the beta wave progresses up the wellbore, the pressure in the wellbore increases because of frictional resistance to the flow of the carrier fluid. The carrier fluid not lost to the formation conventionally must flow to the toe region because the washpipe terminates in that region. When the slurry reaches the upper end of the beta wave, the carrier fluid must travel the distance to the toe region in the small annular space between the screen and the washpipe. As this distance increases, the friction pressure increases, causing the wellbore pressure to increase.

The increased pressure can cause early termination of the gravel pack operation because the wellbore pressure can rise above the formation pressure, causing damage to the formation and leading to a bridge at the fracture. That can lead to an incomplete packing of the wellbore and is generally to be avoided. Thus, gravel pack operations are typically halted when the wellbore pressure approaches the formation fracture pressure.

Thus, a need exists to reduce the pressure in the wellbore resulting from the beta wave traveling farther and farther from the entrance to the return path for the carrier fluid in the gravel slurry.

SUMMARY

The present invention provides for a tool having diverter valves to reduce the pressure in a wellbore caused by frictional resistance to fluid flow as the beta wave of a gravel pack operation makes its way up the wellbore.

Advantages and other features of the invention will become apparent from the following description, drawings, and claims.

DETAILED DESCRIPTION

Figure 1:
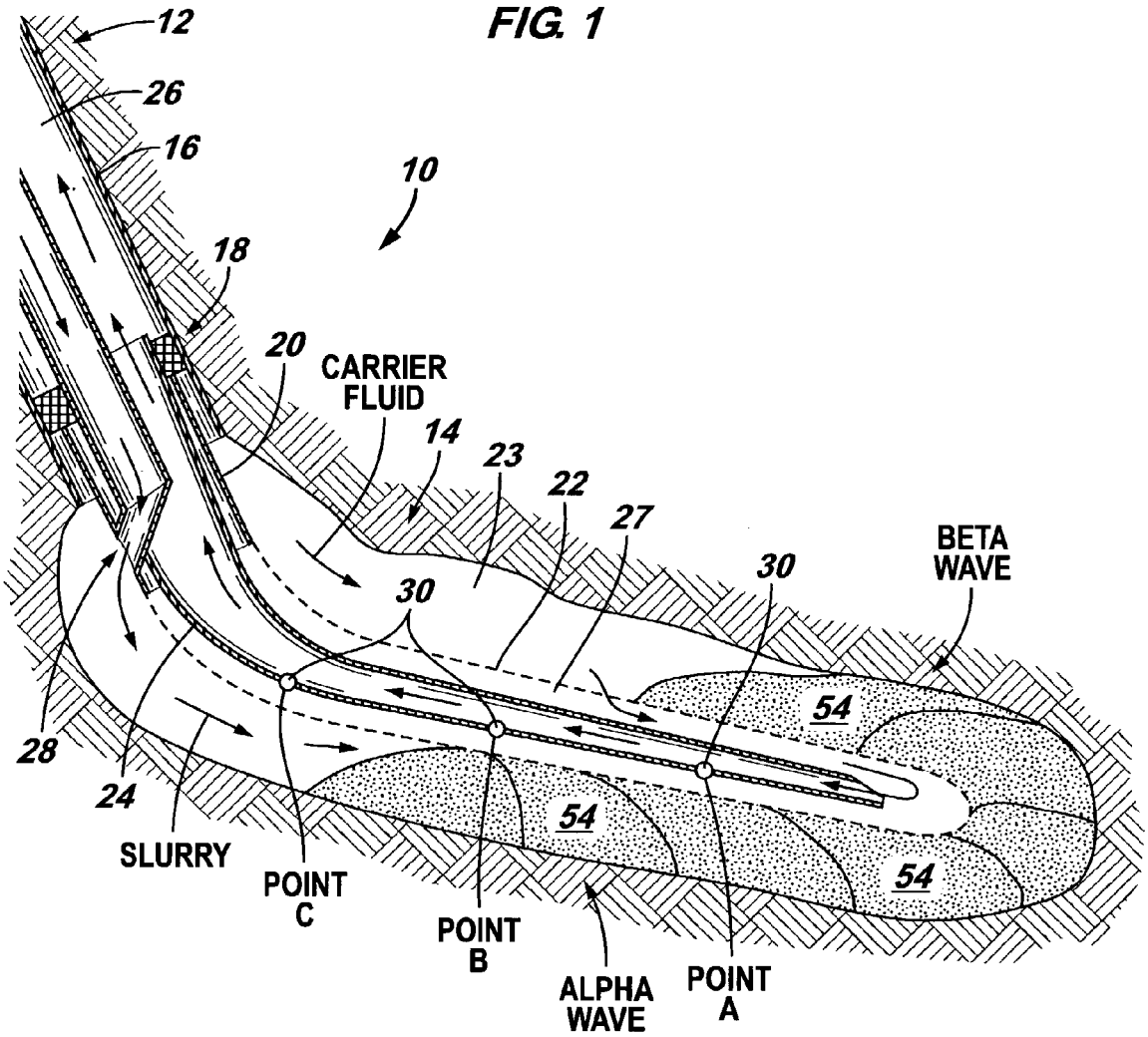
FIG. 1 is a schematic view of wellbore with a service tool therein having diverter valves in accordance with the present invention.

Referring to FIG. 1, a wellbore 10 is shown having a vertically deviated upper section 12 and a substantially horizontal lower section 14. A casing 16 lines upper section 12 and lower section 14 is shown as an open hole, though casing 16 could be placed in lower section 14 as well. To the extent casing 16 covers any producing formations, casing 16 must be perforated to provide fluid communication between the formations and wellbore 10.

A packer 18 is set generally near the lower end of upper section 12. Packer 18 engages and seals against casing 16, as is well known in the art. Packer 18 has an extension 20 to which other lower completion equipment such as screen 22 can attach. Screen 22 is preferably disposed adjacent a producing formation. With screen 22 in place, a lower annulus 23 is formed between screen 22 and the wall of wellbore 10.

A service tool 24 is disposed in wellbore 10, passing through the central portion of packer 18. Service tool 24 extends to the "toe" or lower end of lower section 14. With service tool 24 in place, an upper annulus 26 is formed above packer 18 between the wall of wellbore 10 and the wall of service tool 24. Also, an inner annulus 27 is formed between the inner surface of screen 22 and service tool 24. In FIG. 1, where service tool 24 passes through packer 18, a schematic representation of a crossover 28 is shown. Crossover 28 allows fluids pumped through service tool 24 to emerge into lower annulus 23 below packer 18. Fluids entering service tool 24 below packer 18, such as through the open end of service tool 24 at the toe of wellbore 10, are conveyed upwards through service tool 24. Upon reaching crossover 28, the returning fluids are conveyed through or past packer 18 and into upper annulus 26, through which the return fluids are conveyed to the surface.

Figure 2:
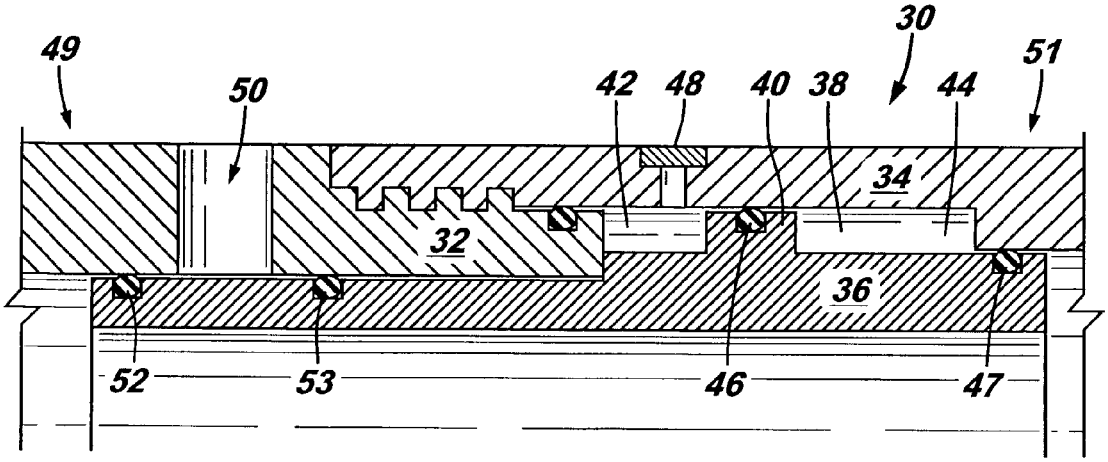
FIG. 2 is a schematic view of one of the diverter valves of FIG. 1.

At least one diverter valve 30 is mounted to service tool 24 below packer 18. Diverter valve 30 preferably forms an integral part of the wall of service tool 24, but other embodiments such as diverter valve 30 being mounted to service tool 24 such that valve 30 covers and seals openings (not shown) in service tool 24 are within the scope of this invention. FIG. 2 shows schematically the components of diverter valve 30. An upper housing 32 attaches to a lower housing 34. Although FIG. 2 shows housings 32, 34 joined by a threaded connection, other connectors may be used. Housings 32, 34 may also be a single housing, but are preferably two sections, as shown. A piston 36 is sealingly and moveably mounted to housings 32, 34, and is located radially inward of housings 32, 34. Together, housings 32, 34 and piston 36 form a sealed chamber 38. Chamber 38 is divided by piston head 40 into an upper chamber 42 and a lower chamber 44. Piston head 40 carries a seal 46 that seals against lower housing 34. Piston 36 carries a seal 47 that seals against lower housing 34 and seals the lower end of lower chamber 44. Piston 36 has an upper end 49 and a lower end 51. The surface area of upper end 49 is less than the surface area of lower end 51.

Lower housing 34 has a pressure-responsive member 48 mounted in the wall of lower housing 34 and member 48 forms an integral portion of such wall. Pressure-responsive member 48 is located adjacent to upper chamber 42. Member 48 may be, for example, a rupture disk. When member 48 is in its "open" state, it allows fluid communication between inner annulus 27 and upper chamber 42. Upper housing 32 has a port 50. Depending on the position of piston 36, port 50 can provide fluid communication between inner annulus 27 and the interior of service tool 24. Piston 36 carries seals 52, 53 that seal against upper housing 32 to prevent or allow such fluid communication. Seal 53 also serves to seal the upper end of upper chamber 42.

In operation, lower completion equipment including packer 18, packer extension 20, and screen 22 are placed in wellbore 10. Service tool 24 is run into wellbore 10 through packer 18 such that crossover 28, diverter valve(s) 30, and the open lower end of service tool 24 are properly positioned. Because chamber 38 is initially set at atmospheric pressure, and because the surface area of lower end 51 of piston 36 is greater than upper end 49 of piston 36, piston 36 is hydraulically biased to its upward position as service tool 24 is lowered into position within wellbore 10, thereby ensuring port 50 remains closed until purposely opened (or, equivalently, covering and sealing holes in service tool 24). Additional safeguards such as a mechanical lock to ensure port 50 does not accidentally open due to a drop on the rig may be added.

A gravel slurry is pumped into service tool 24 and ejected into lower annulus 23. The gravel slurry may be of various concentrations of particulates and the carrier fluid can be of various viscosities. In substantially horizontal wellbores, and particularly with a low-viscosity carrier fluid such as water, the placement or deposition of gravel generally occurs in two stages. During the initial stage, known as the "alpha wave", the gravel precipitates as it travels downward to form a continuous succession of dunes 54 (FIG. 1). Depending on factors such as slurry velocity, slurry viscosity, sand concentration, and the volume of lower annulus 23, each dune 54 will grow in height until the fluid velocity passing over the top of dune 54 is sufficient to erode the gravel and deposit it on the downstream side of dune 54. The process of build-up of dune 54 to a sustainable height and deposition on the downstream side to initiate the build-up of each successive dune 54 is repeated as the alpha wave progresses to the toe of wellbore 10.

As the alpha wave travels to the toe and the gravel settles out, the carrier fluid preferably travels in lower annulus 23 or passes through screen 22 and enters inner annulus 27 and continues to the toe where it is picked up by service tool 24 and returned to surface. A proper layer of "filter cake", or "mud cake" (a relatively thin layer of drilling fluid material lining wellbore 10), helps prevent excess leak-off to the formation.

When the alpha wave reaches the toe of wellbore 10, the gravel begins to backfill the portion of lower annulus 23 left unfilled by the alpha wave. This is the second stage of the gravel pack and is referred to as the "beta wave". As the beta wave progresses toward the heel of wellbore 10 and gravel is deposited, the carrier fluid passes through screen 22 and enters inner annulus 27. So long as diverter valves 30 remain closed, the carrier fluid must make its way to the toe to be returned to the surface. As the beta wave gets farther and farther from the toe, the carrier fluid entering inner annulus 27 must travel farther and farther to reach the toe. The flowpath to the toe through lower annulus 23 is effectively blocked because of the deposited gravel. As is common in fluid flow, the pressure in wellbore 10 tends to increase due to the increased resistance resulting from the longer and more restricted flowpath.

Figure 3:
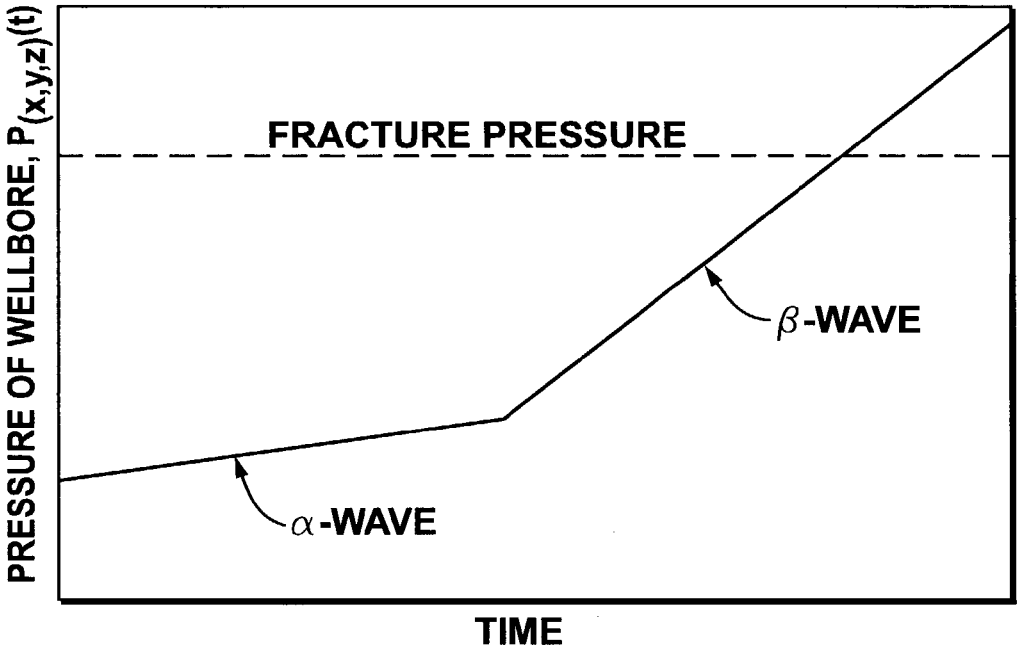
FIG. 3 (Prior Art)
FIG. 3 is a graph of wellbore pressure as a function of time in a conventional gravel pack operation in a horizontal wellbore.

FIG. 3 shows a typical plot of expected pressure in wellbore 10 with diverter valves 30 remaining closed. For reference, FIG. 3 also shows the limiting pressure or fracture pressure of the formation, above which damage to the formation may occur. Pumping operations are generally halted just below fracture pressure. This early termination of pumping results in a less than complete gravel pack.

Figure 4:
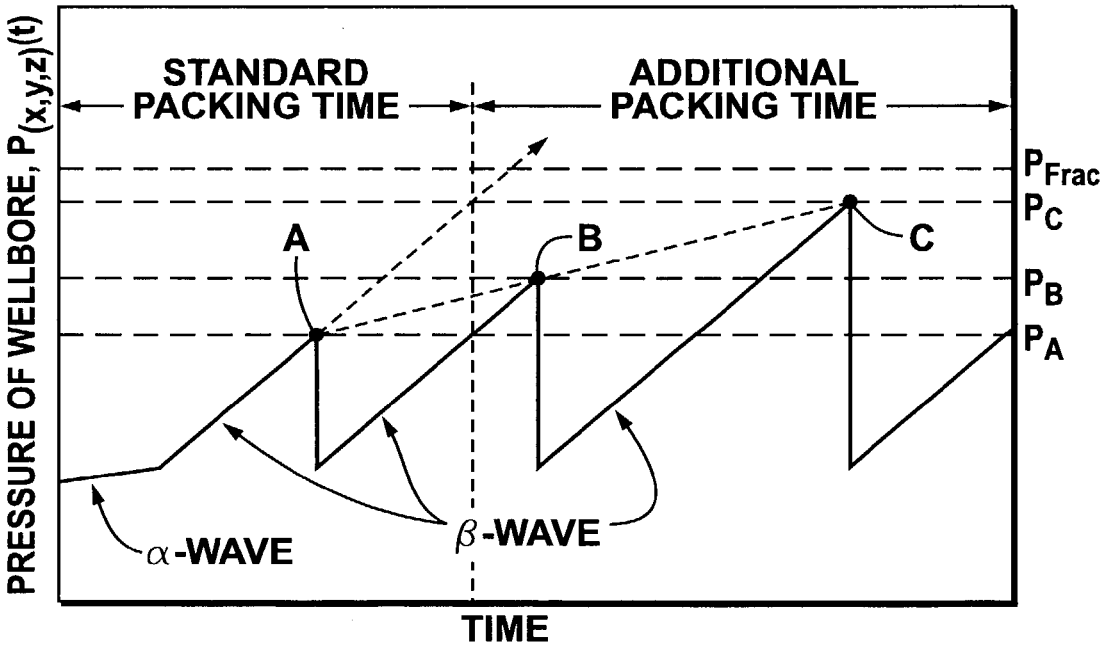
FIG. 4 is a graph of wellbore pressure as a function of time in a gravel pack operation in a horizontal wellbore in which the service tool of FIG. 1 is used.

FIG. 4 shows a typical pressure profile expected with the use of diverter valves 30. Valves 30 are strategically placed along the lower length of service tool 24. Proper placement of valves 30 and the actuation pressure for pressure-responsive members 48 vary according to the pressure environment of a particular wellbore. This can be modeled or simulated using known computational techniques for estimating wellbore pressure. Using such techniques allows engineering estimates for optimal placement of valves 30 and selection of pressure-responsive members 48.

FIGS. 1 and 4 show schematically the location of diverter valves 30 and the pressure plot corresponding to their use. Valves 30 are located at points A, B, and C on FIG. 1. After the alpha wave reaches the toe and when the beta wave reaches point A, the pressure is just sufficient to actuate pressure-responsive member 48 at point A. Actuation of pressure-responsive member 48 at point A exposes upper chamber 42 of that valve 30 to the pressure in inner annulus 27. This pressure exceeds the atmospheric pressure in lower chamber 44, causing piston 36 to move downward, exposing port 50 to inner annulus 27. With port 50 in its "open" state, the carrier fluid no longer must travel to the open end of service tool 24 to return to surface. It enters service tool 24 through port 50 at point A. This allows the pressure to drop, as shown in FIG. 4.

As the beta wave continues up wellbore 10 toward the heel, the pressure will increase as the flow path again lengthens. However, upon passing point B, the pressure will be sufficient to actuate pressure-responsive member 48 at point B. As before, actuation of pressure-responsive member 48 causes actuation of valve 30 at point B. That creates a flow path from inner annulus 27 into service tool 24 at point B, thus relieving the pressure again. This process is repeated for each additional diverter valve 30, as illustrated again at point C.

FIG. 4 shows the relative time a conventional (no diverter valves 30) gravel pack will be allowed to run until halted at the pressure anticipated at point C, just below the fracture pressure. It also shows the additional relative time permitted when diverter valves 30 are used. The term "relative" time is used to indicate the controlling factor is really wellbore versus fracture pressure since time van be extended or shortened by varying other parameters. However, by controlling pressure, extended relative pumping times can be gained. Additional time is gained because the open diverter valves 30 reduce the resistance to the return of carrier fluids to the surface due to shortened flow paths. If diverter valves 30 are properly chosen, the gravel pack operation can be run until the screens are completely covered, while never exceeding the fracture pressure. Diverter valves 30 can and generally should have pressure-responsive members 48 that vary in actuation pressures one from the other.

The rate of fluid return can be regulated using a choke, as is well known in the art. Using a choke gives an operator a means of control over the actuation of a pressure-responsive member 48 by allowing the operator to increase the wellbore pressure to the actuation level, should the operator so choose.

Though described in specific terms using specific components, the invention is not limited to those components. Other elements may be interchangeably used, perhaps with slight modifications to account for variations. For example, pressure-responsive member 48 may be a spring-biased valve or a barrier held by shear pins. Also, the invention may have other applications in which it is desirable to limit wellbore pressure that are within the scope of this invention.

Although only a few example embodiments of the present invention are described in detail above, those skilled in the art will readily appreciate that many modifications are possible in the example embodiments without materially departing from the novel teachings and advantages of this invention. Accordingly, all such modifications are intended to be included within the scope of this invention as defined in the following claims. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A service tool for use in a well, comprising:

a tubular having a central passageway therethrough;

a crossover through which fluid flowing down the central passageway can exit the central passageway and enter a lower annulus below a packer and fluid flowing up the central passageway can exit the central passageway and enter an upper annulus above the packer;

a valve mounted to the tubular, the valve comprising a valve housing and a piston slidably mounted in the valve housing to allow or block fluid flow from the lower annulus into the central passageway through an opening in a wall of the tubular, the valve housing comprising a chamber and the piston comprising a piston head extending into the chamber to divide the chamber into a first subchamber and a second subchamber on opposed sides of the piston head, the first subchamber and the second subchamber being at atmospheric pressure prior to actuation of the valve; and in which the valve is actuated by a pressure-responsive member responsive to absolute pressure to expose the first subchamber to pressure in the lower annulus which moves the piston and opens the valve, the valve being located adjacent a screen in the well.

2. The service tool of claim 1 in which the pressure-responsive member is a rupture disk.

3. The service tool of claim 1 in which the housing further comprises an upper housing joined to a lower housing.

4. The service tool of claim 1 in which the piston has a lower end and an upper end, and in which the area of the lower end is greater than the area of the upper end.

5. The service tool of claim 1 in which the piston carries seals to control fluid flow.

6. The service tool of claim 1 in which the service tool is run through the packer and inside a screen.

7. The service tool of claim 1 in which a plurality of valves are spaced along the length of the service tool, and in which each valve is set to actuate independently from the other valves to an open state when the wellbore pressure reaches some predetermined threshold.

8. The service tool of claim 7 in which the wellbore pressure drops each time a valve is actuated to an open state.

9. The service tool of claim 7 in which the wellbore pressure never exceeds the fracture pressure of a wellbore formation.

10. A system for use in a well, comprising:

a service tool configured to deliver a gravel slurry in a gravel packing procedure, the service tool having a wall formed in a tubular shape and a plurality of valve assemblies mounted in the wall, each valve assembly comprising:

an upper housing having a port therethrough;

a lower housing joined to the upper housing, the lower housing having a pressure-responsive member therein responsive to absolute pressure;

a piston sealingly and moveably mounted within the upper and lower housings to form a chamber, the piston having a piston head extending into the chamber and sealingly dividing the chamber into an upper chamber and a lower chamber maintained at atmospheric pressure until actuation of the piston, the pressure-responsive member being adjacent to the upper chamber; and in which the piston allows or prevents fluid communication through the port.

11. The system of claim 10 in which the pressure-responsive member is a rupture disk.

12. The system of claim 10 in which actuation of the pressure-responsive member causes the piston to move, exposing the port.

13. The system of claim 10 in which the piston has a lower end and an upper end, and in which the area of the lower end is not equal to the area of the upper end.

14. The system of claim 10 in which the piston carries seals to control fluid flow paths.

15. A method to reduce wellbore pressure during pumping operations, comprising:

a) providing a service tool to which diverter valves can be mounted;

b) spacing the diverter valves along the service tool's length such that the diverter valves will land adjacent a screen in the wellbore when the service tool is placed in the wellbore;

c) setting each diverter valve to actuate independently from the other diverter valves to an open state when the absolute wellbore pressure reaches some predetermined threshold;

d) actuating each diverter valve by positioning a piston head in a valve housing chamber to divide the valve housing chamber into opposed subchambers acting on opposed sides of the piston head and maintaining the opposed subchambers at atmospheric pressure until the absolute wellbore pressure reaches the predetermined threshold:

e) placing the service tool in the wellbore; and f) performing pumping operations.

16. The method of claim 15 in which placing the service tool in the wellbore further comprises running the service tool through a packer and inside a sand screen.

17. The method of claim 15 in which spacing the diverter valves further comprises computing the optimal locations for each diverter valve based on anticipated welibore pressure and formation fracture pressure.

* * * * *